US007492336B2

(12) United States Patent
Kim

(10) Patent No.: US 7,492,336 B2
(45) Date of Patent: Feb. 17, 2009

(54) METHOD AND APPARATUS FOR PRE-CHARGING ELECTRO-LUMINESCENCE PANEL

(75) Inventor: Seong Gyun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 723 days.

(21) Appl. No.: 11/022,689

(22) Filed: Dec. 28, 2004

(65) Prior Publication Data

US 2005/0219166 A1 Oct. 6, 2005

(30) Foreign Application Priority Data

Mar. 31, 2004 (KR) ..... 10-2004-0022123

(51) Int. Cl.
*G09G 3/30* (2006.01)

(52) U.S. Cl. ..... 345/76; 345/92; 315/169.3

(58) Field of Classification Search ..... 345/39, 345/45–46, 50, 60, 64, 76–78, 87, 92–100, 345/204, 214, 690; 315/169.1–169.4

See application file for complete search history.

(56) References Cited

U.S. PATENT DOCUMENTS

| | | | | |
|---|---|---|---|---|
| 5,708,454 | A * | 1/1998 | Katoh et al. | 345/100 |
| 6,731,266 | B1 * | 5/2004 | Jung | 345/103 |
| 7,106,281 | B2 * | 9/2006 | Kim et al. | 345/76 |
| 2002/0167505 | A1 | 11/2002 | LeChevalier | 345/204 |
| 2006/0125744 | A1 * | 6/2006 | Klein et al. | 345/82 |

* cited by examiner

*Primary Examiner*—Richard Hjerpe
*Assistant Examiner*—Mansour M Said
(74) *Attorney, Agent, or Firm*—Morgan Lewis & Bockius LLP

(57) ABSTRACT

An electro-luminescence (EL) display device includes an electro-luminescence display panel including a plurality of pixels arranged in a matrix form at pixel areas defined by intersections between gate lines and data lines, each of the pixels having an EL cell connected to a first voltage source and a cell driver, the cell driver connected to a respective one of the gate lines and a respective one of the data lines and connected between a second voltage source and the EL cell, and a pre-charger for pre-charging a storage capacitor in the cell driver into a first pre-charge voltage using a pre-charge voltage source and then floating the respective data line in a pre-charge period prior to an application of a data signal, thereby arriving at a second pre-charge voltage by a discharge of the first pre-charge voltage of the storage capacitor.

18 Claims, 6 Drawing Sheets

METHOD AND APPARATUS FOR PRE-CHARGING ELECTRO-LUMINESCENCE PANEL

The present application claims the benefit of Korean Patent Application No. P2004-22123 filed in Korea on Mar. 31, 2004, which is hereby incorporated by reference.

BACKGROUND OF THE INVENTION

1. Field of the Invention

The present invention relates to an electro-luminescence display (ELD) device, and more particularly, to a method and apparatus for pre-charging an electro-luminescence display panel wherein a storage capacitor can be pre-charged within a desired time.

2. Discussion of the Related Art

Until recently, display devices generally employed cathode-ray tubes (CRTs) or television monitors. Presently, many efforts are being made to study and develop various types of flat panel display devices, such as liquid crystal display devices (LCDs), field emission displays (FEDs), plasma display panel (PDPs), and electro-luminescence (EL) displays, as substitutions for CRTs because of their lightness, thin profile, and compact size.

In particular, an EL display panel is a self-luminous device and does not need an additional light source to emit light. Accordingly, an EL display panel has a very thin profile. In addition, the EL display panel can operate using a DC low voltage, e.g., 10V, thereby having low power consumption and fast response time. Further, the EL display panel is an integrated device having wide viewing angle, and high image contrast, such that it has high endurance of external impacts and a wide range of applications.

There are two types of EL display panels, an inorganic EL device, which uses an inorganic compound as a phosphorous material, and an organic EL display device, which uses an organic compound as the phosphorous material. In particular, an organic EL display device includes an electron injection layer, an electron carrier layer, a light-emitting layer, a hole carrier layer and a hole injection layer. When a predetermined voltage is applied between an anode and a cathode, electrons produced from the cathode are moved via the electron injection layer and the electron carrier layer into the light-emitting layer while holes produced from the anode are moved via the hole injection layer and the hole carrier layer into the light-emitting layer. As a result, the light-emitting layer emits light by a recombination of electrons and holes fed from the electron carrier layer and the hole carrier layer.

FIG. 1 is a schematic diagram of an electro-luminescence display panel according to the related art. In FIG. 1, an organic EL display panel includes a pixel matrix 20 having pixels PE arranged at each area defined by intersections between gate lines GL and data lines DL, a gate driver 22 for driving the gate lines GL, and a data driver 24 for driving the data lines DL. In particular, the gate driver 24 supplies a scanning pulse to sequentially drive the gate lines GL1 to GLm. Each of the pixels PE receives a video data signal (hereinafter referred briefly to as "data signal") from a corresponding data line DL when the scanning pulse is applied to a corresponding gate line GL, to thereby generate light in accordance to the data signal.

FIG. 2 is a circuit diagram of the pixel shown in FIG. 1. In FIG. 2, each of the pixels PE includes an EL cell OLED having a cathode connected to a ground voltage source GND, a cell driver 16, an anode of the EL cell OLED. The cell driver 16 connects to the corresponding gate line GL, the corresponding data line DL and a supply voltage source VDD and an anode of the EL cell OLED, to thereby drive the EL cell OLED.

In particular, the cell driver 16 includes a first switching thin film transistor (TFT) T1 connected to the supply voltage source VDD and a second switching TFT T2. The second TFT T2 also is connected between the supply voltage source VDD and the anode of the EL cell OLED to form a current mirror along with the first TFT T1. The cell driver 16 also includes a third switching TFT T3, which is connected between the data line DL and the first TFT T1 and is controlled by the gate line GL, and a fourth switching TFT T4, which is connected between the third TFT T3 and the gate electrodes of the first and second TFTs T1 and T2 and is controlled by the gate line GL. In addition, the cell driver 16 includes a storage capacitor Cst connected between the voltage supply source VDD and the gate electrodes of the first and second TFTs T1 and T2.

If a scanning pulse is applied to the gate line GL, then the third and fourth TFTs T3 and T4 are turned on to apply a data signal from the data line DL to the gate electrodes of the first and second TFTs T1 and T2, thereby charging a driving voltage for driving the first and second TFTs T1 and T2 into the storage capacitor Cst. Thus, a current corresponding to the driving voltage charged in the storage capacitor Cst flows into the first TFT T1. Subsequently, the second TFT T2 mirrors the current flowing in the first TFT T1 and applies the current to the EL cell OLED, thereby allowing the EL cell OLED to emit light proportional to the applied current. Further, even though the third and fourth switching TFTs T3 and T4 are turned off, the driving voltage charged in the storage capacitor Cst allows the first and second TFTs T1 and T2 to apply a certain current until a data signal of the next frame is applied, thereby sustaining light-emission of the EL cell OLED.

As shown in FIG. 1, the date driver 24 includes a data supplier 28 for supplying the data signal in form of a current signal to the data line DL using a current sink circuit. Since the data supplier 28 uses a very small current, a lot of time is needed to charge the storage capacitor Cst to a desired driving voltage. Especially when implementing a low gray level requiring relatively lowering a voltage difference between the driving voltage and the supply voltage VDD, a large current must be applied to the storage capacitor Cst. As a result, it becomes difficult to charge the storage capacitor Cst into a low gray level of driving voltage.

In order to overcome such a low gray level charging problem, the data driver 24 further includes a pre-charger 26. The pre-charger 26 applies a pre-charging signal before the data signal is applied to the data lines DL1 to DLn to pre-charge the storage capacitor Cst of each pixel PE, thereby reducing a charging time for a low gray level of driving voltage.

FIG. 3 is a driving waveform diagram of a pre-charging method for the electro-luminescence display panel shown in FIG. 1. In FIG. 3, during a first time interval when a low-voltage scanning pulse is applied to the $k^{th}$ gate line GLk, a pre-charging signal P is applied by the pre-charger 26 (shown in FIG. 1) before the data supplier 28 (shown in FIG. 1) supplies a data signal IDk. Thus, the pre-charging signal P pre-charges the storage capacitor Cst on the $k^{th}$ horizontal line. Then, during a subsequent time interval when the low-voltage scanning pulse is applied to the $(k+1)^{th}$ gate line GLk+1, the pre-charging signal P is applied before a data signal IDk+1 to pre-charge the storage capacitor Cst on the $(k+1)^{th}$ horizontal line.

In particular, the pre-charger 26 could utilize a current source, a voltage source or a floating method to pre-charge the storage capacitor Cst of each pixel PE. However, when the pre-charger 26 employs a current source, it is necessary to know an accurate capacitance value in order to charge the data line DL and the storage capacitor Cst into a desired voltage value. Since it is impossible to accurately detect a parasitic capacitance existing in the data line DL, a usage of the current source is not available.

When the pre-charger 26 employs a voltage source where a voltage drop occurs from the supply voltage source VDD, a voltage pre-charged in the storage capacitor Cst is differentiated depending upon a location of the storage capacitor Cst. Thus, the storage capacitors Cst of a panel are not uniformly pre-charged when a voltage source is employed.

Further, although the floating method, where the data line DL is floated, and the storage capacitor Cst is pre-charged into a desired driving voltage by a discharge current from each pixel PE, permits a pre-charging of the storage capacitor Cst, a resistance of the EL cells OLED connected to each other in a diode structure is very large. Thus, it is impossible to sufficiently discharge electric charges on the data line DL within the pre-charging time interval by a small discharge current of about hundreds of nA. Thus, the charging time is large when using the floating method.

SUMMARY OF THE INVENTION

Accordingly, the present invention is directed to an electro-luminescence display device that substantially obviates one or more of problems due to limitations and disadvantages of the related art.

An object of the present invention is to provide a method and apparatus for pre-charging an electro-luminescence display panel wherein a storage capacitor can be pre-charged within a desired time.

Another object of the present invention is to provide a method and apparatus for pre-charging an electro-luminescence display panel wherein a storage capacitor can be uniformly pre-charged irrespectively of a location of a storage capacitor.

Yet another object of the present invention is to provide a method and apparatus for driving an electro-luminescence display panel using the above-mentioned pre-charging method and apparatus.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electro-luminescence display device includes an electro-luminescence display panel including a plurality of pixels arranged in a matrix form at pixel areas defined by intersections between gate lines and data lines, each of the pixels having an EL cell connected to a first voltage source and a cell driver, the cell driver connected to a respective one of the gate lines and a respective one of the data lines and connected between a second voltage source and the EL cell, and a pre-charger for pre-charging a storage capacitor in the cell driver into a first pre-charge voltage using a pre-charge voltage source and then floating the respective data line in a pre-charge period prior to an application of a data signal, thereby arriving at a second pre-charge voltage by a discharge of the first pre-charge voltage of the storage capacitor.

In another aspect, the method of pre-charging an electro-luminescence (EL) display panel includes pre-charging a storage capacitor of a pixel connecting to a data line and a gate line in the EL display panel to a first pre-charge voltage using a pre-charge voltage source during a first pre-charge interval, and floating the data line to arrive at a second pre-charge voltage by a discharge of the first pre-charge voltage at the storage capacitor during a second pre-charge interval.

In yet another aspect, the apparatus of pre-charging an electro-luminescence (EL) display panel includes pre-charging means for pre-charging a storage capacitor of each pixel connected to gate lines supplied with a scanning pulse using a first pre-charging step during a first pre-charging period and then a second pre-charging step during a second pre-charging period prior to an application of a data signal, the first and second pre-charging steps being different from each other.

In another aspect, the method of pre-charging an electro-luminescence (EL) display panel includes pre-charging a storage capacitor of each pixel connected to gate lines supplied with a scanning pulse in at least a first pre-charging step during a first pre-charging period and a second pre-charging step during a second pre-charging period before an application of a data signal, the first and second pre-charging step being different from each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
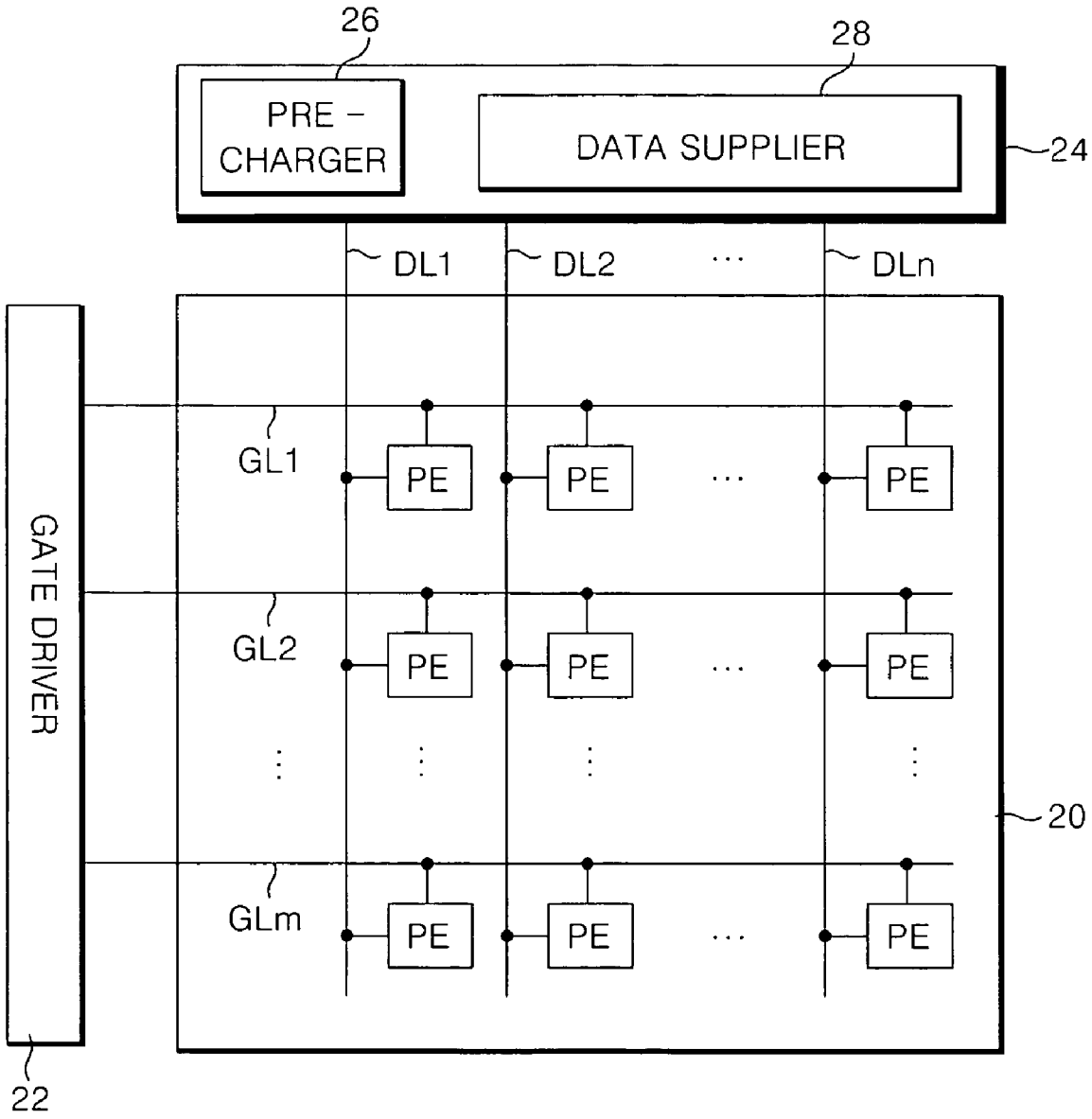
FIG. 1 RELATED ART
FIG. 1 is a schematic diagram of an electro-luminescence display panel according to the related art.
Figure 2:
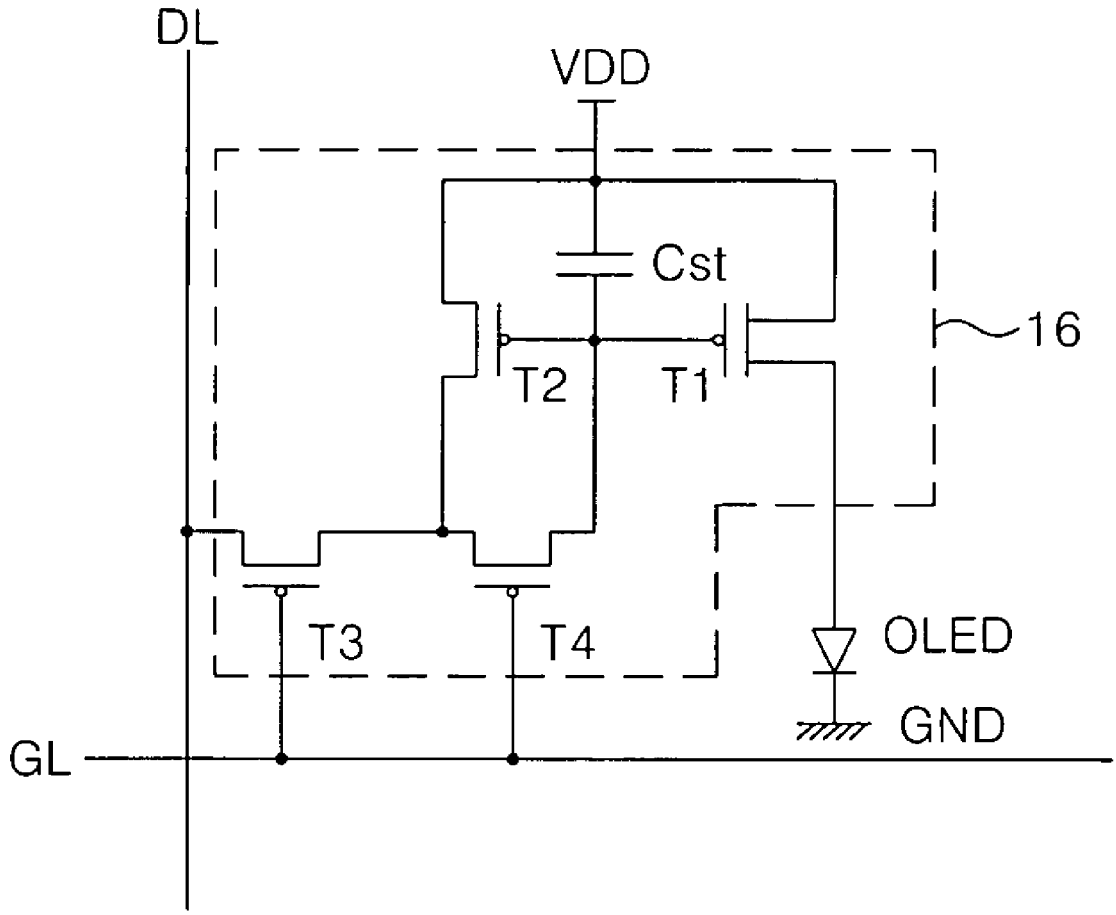
FIG. 2 RELATED ART
FIG. 2 is a circuit diagram of the pixel shown in FIG. 1.
Figure 3:
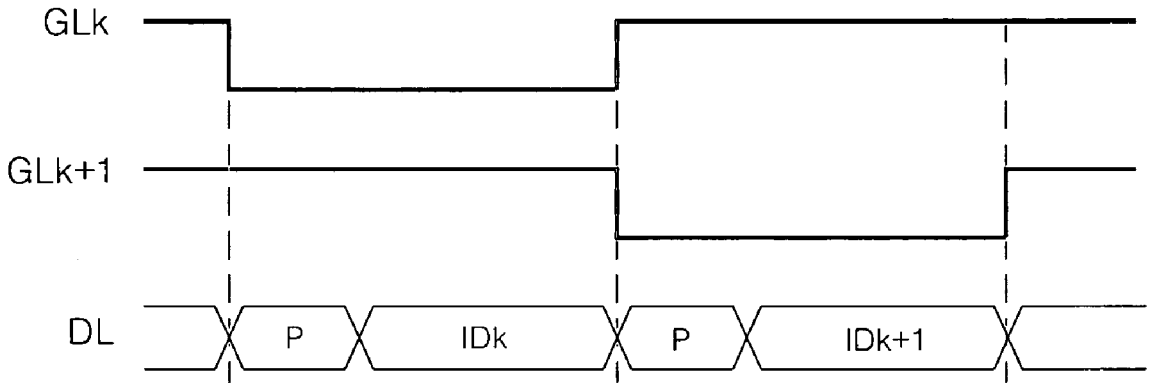
FIG.3 RELATED ART
FIG. 3 is a driving waveform diagram of a pre-charging method for the electro-luminescence display panel shown in FIG. 1.
Figure 4:
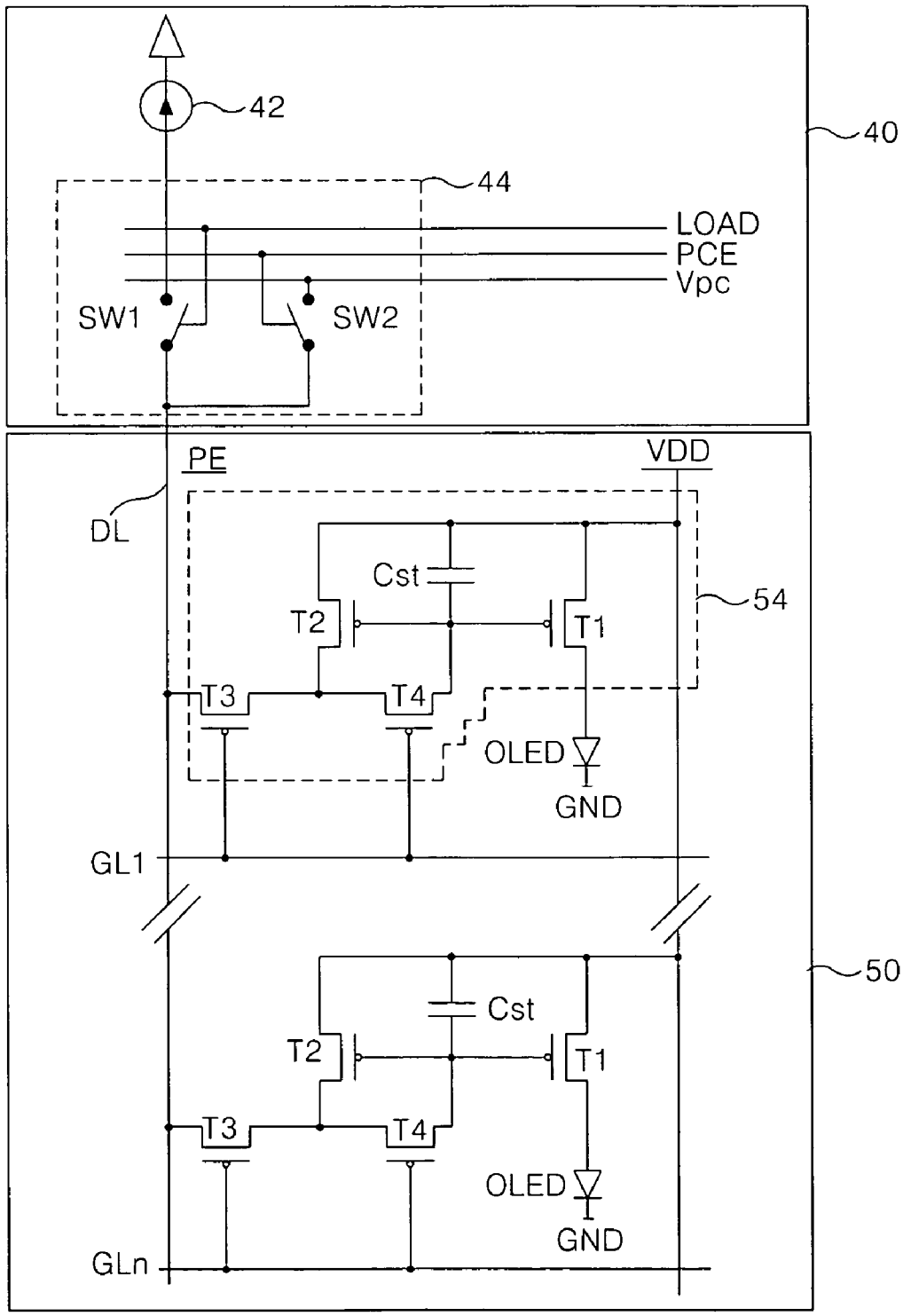
FIG. 4 is a circuit diagram of an electro-luminescence display panel including a pre-charger according to an embodiment of the present invention.

FIG. 4 is a circuit diagram of an electro-luminescence display panel including a pre-charger according to an embodiment of the present invention. In FIG. 4, an EL display panel may include a pixel matrix 50 having pixels PE arranged at each area defined by intersections between gate lines GL and data lines DL, a gate driver (not shown) for driving the gate lines GL, and a data driver 40 for driving the data lines DL. The gate driver (not shown) may supply a scanning pulse to sequentially drive the gate lines GL1 to GLm.

Each of the pixels PE may receive a video data signal (hereinafter referred briefly to as "data signal") from a corresponding data line DL when a scanning pulse is applied to a corresponding gate line GL, to thereby generate light corresponding to the data signal. In particular, each of the pixels PE may include an EL cell OLED having a cathode connected to a ground voltage source GND, and a cell driver 54 connected to the gate line GL, the data line DL and a supply voltage source VDD and an anode of the EL cell OLED, to thereby drive the EL cell OLED.

In addition, the cell driver 54 may include a first switching thin film transistor (TFT) T1 connected to the supply voltage source VDD and a second switching TFT T2. The second TFT T2 also may be connected between the supply voltage source VDD and the anode of the EL cell OLED to form a current mirror along with the first TFT T1. The cell driver 54 also may include a third switching TFT T3, which is connected between the data line DL and the first TFT T1 and is controlled by the gate line GL, and a fourth switching TFT T4, which is connected between the third TFT T3 and the gate electrodes of the first and second TFTs T1 and T2 and is controlled by the gate line GL. In addition, the cell driver 54 may include a storage capacitor Cst connected between the voltage supply source VDD and the gate electrodes of the first and second TFTs T1 and T2.

When a scanning pulse is applied to the gate line GL, then the third and fourth TFTs T3 and T4 may be turned on to apply a data signal from the data line DL to the gate electrodes of the first and second TFTs T1 and T2, thereby charging a driving voltage for driving the first and second TFTs T1 and T2 into the storage capacitor Cst. Thus, a current corresponding to the driving voltage charged in the storage capacitor Cst may flow into the first TFT T1. Subsequently, the second TFT T2 may mirror the current flowing in the first TFT T1 and may apply the current to the EL cell OLED, thereby allowing the EL cell OLED to emit light proportional to the applied current. Further, even though the third and fourth switching TFTs T3 and T4 are turned off, the driving voltage charged in the storage capacitor Cst may allow the first and second TFTs T1 and T2 to apply a certain current until a data signal of the next frame is applied, thereby sustaining light-emission of the EL cell OLED.

The data driver 40 may include a data supplier 42 for supplying a data signal to the data line DL, and a pre-charger 44 for pre-charging the storage capacitor Cst of each of the pixels PE before an application of the data signal. In particular, the data supplier 42 may supply a data signal, e.g., a current signal "ID", to the data line DL whenever the scanning pulse is applied using a current sink circuit. In addition, the pre-charger 44 may pre-charge the storage capacitor Cst of each of the pixels PE to a desired driving voltage in a two-step pre-charging method before an application of the data signal ID from the data supplier 42 during every time interval when a scanning pulse is applied to the gate line GL.

Figure 5:
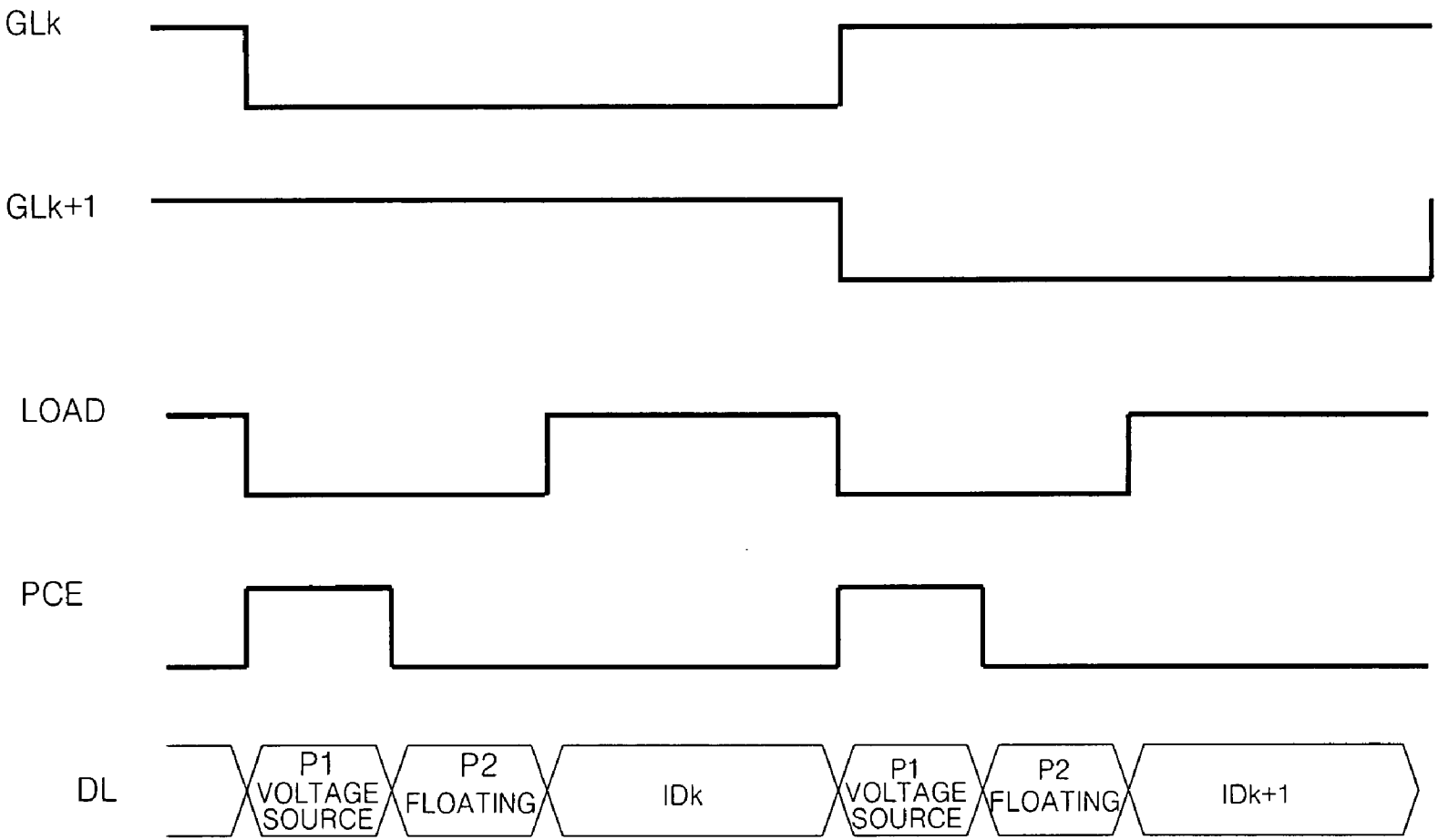
FIG. 5 is a driving waveform diagram of a pre-charging method for the electro-luminescence display panel shown in FIG. 4.

FIG. 5 is a driving waveform diagram of a pre-charging method for the electro-luminescence display panel shown in FIG. 4. As shown in FIG. 5, during a first time interval when a low-voltage scanning pulse is applied to the $k^{th}$ gate line GLk, a first pre-charging step P1 and a second pre-charging step P2 may be applied by the pre-charger 44 (shown in FIG. 4) before the data supplier 42 (shown in FIG. 4) supplies a data signal IDk. Thus, the storage capacitor Cst on the $k^{th}$ horizontal line may be pre-charged. Then, during a subsequent time interval when the low-voltage scanning pulse is applied to the $(k+1)^{th}$ gate line, the first and second pre-charging steps P1 and P2 may be applied to pre-charge the storage capacitor Cst on the $(k+1)^{th}$ horizontal line. In addition, the first pre-charging step P1 may employ a pre-charge voltage Vpc, and the second pre-charging step P2 may employ a scheme of floating the data line DL.

As shown in FIG. 4, the pre-charger 44 may include a first switch SW1 for selectively connecting the data line DL to the data supplier 42 in response to a first control signal LOAD, and a second switch SW2 for selectively connecting the data line DL to the pre-charge voltage Vpc in response to a second control signal PCE.

During the first pre-charge step, when the first control signal LOAD is LOW and the second control signal PCE is HIGH (as shown in FIG. 5), the first switch SW1 may switch open the connection between the data supplier 42 and the data line DL, and the second switch SW2 may establish the connection between the pre-charge voltage Vpc and the data line DL, thereby applying a pre-charge voltage Vpc to the data line DL. Thus, the pre-charger 44 may pre-charge the storage capacitor Cst of each pixel PE connected to the data line DL and the gate lines GLk and GLk+1 supplied with the scanning pulse. As a result, the storage capacitor Cst may be pre-charged to a voltage difference (VDD−Vpc) between the supply voltage source VDD and the pre-charge voltage Vpc. In particular, the pre-charge voltage Vpc may be set to be lower than a target voltage to compensate for a voltage drop of the supply voltage source VDD.

Subsequently, during the second pre-charge step, when the first control signal LOAD is LOW and the second control signal PCE is LOW (as shown in FIG. 5), the first and second switches SW1 and SW2 may disconnect the data line DL from both the data supplier 42 and the pre-charge voltage Vpc, thereby floating the data line DL. Thus, the voltage difference (VDD−Vpc) charged in the storage capacitor Cst may be discharged via the first TFT T1 to the supply voltage source/line VDD. As a result, the storage capacitor Cst may be ultimately pre-charged to a second pre-charge voltage Vth by discharging the voltage difference {VDD−Vpc−(VDD−Vth)}, where Vth refers to a threshold voltage of the first TFT T1. Accordingly, even though a voltage drop of the supply voltage line VDD occurs due to a location of the pixel PE, the voltage drop of the supply voltage source VDD may be compensated. As a result, the storage capacitor Cst may be pre-charged to a constant voltage, the threshold voltage Vth of the first TFT T1, irrespectively of its location in the panel.

Figure 6:
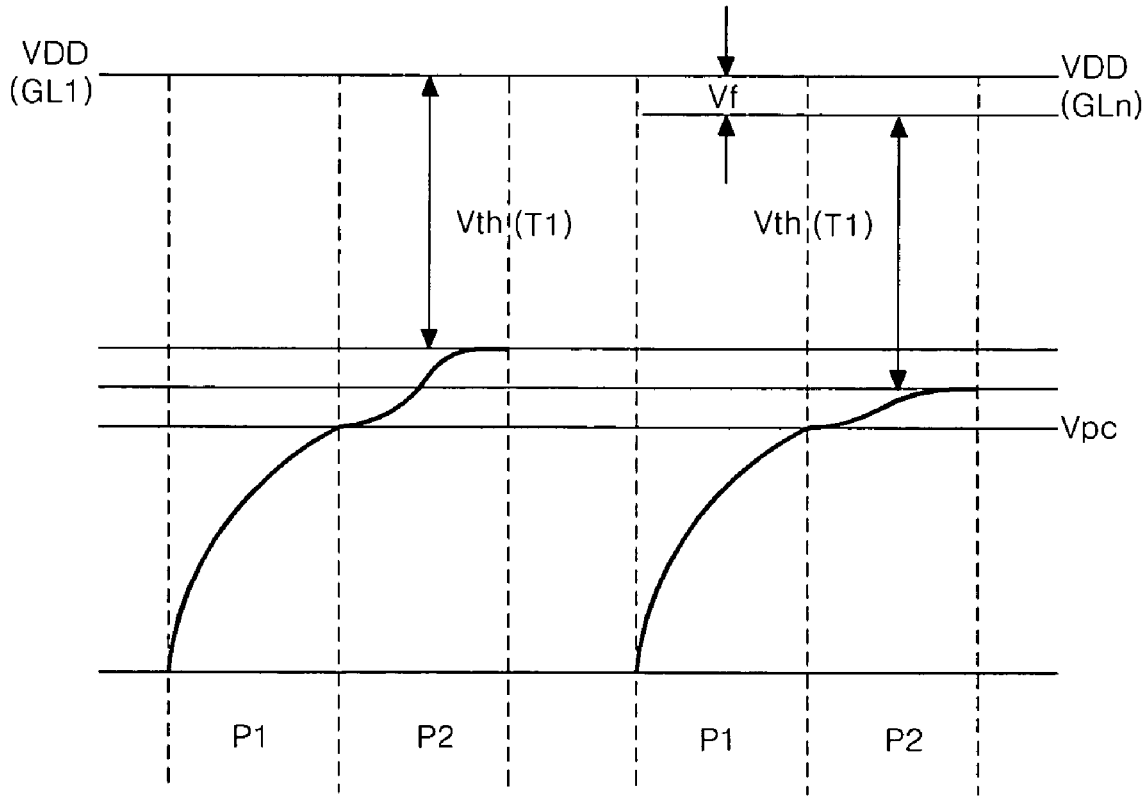
FIG. 6 is a waveform diagram comparatively representing voltages pre-charged in the storage capacitors of the pixels connected to the first and $n^{th}$ gate lines.

FIG. 6 is a waveform diagram comparatively representing voltages pre-charged in the storage capacitors of the pixels connected to the first and $n^{th}$ gate lines. As shown in FIG. 6, there may be almost no voltage drop between the voltage at the supply voltage source VDD and the voltage being applied to the first gate line GL1. Thus, the storage capacitors Cst for the pixels PE connected to the first gate line GL1 may be pre-charged by discharging the voltage difference {VDD−Vpc−(VDD−Vth−Vpc)} to the threshold voltage Vth. Further, since there may be a voltage drop Vf between the voltage at the supply voltage source VDD and the voltage being applied to the $n^{th}$ gate line GLn, the first TFTs T1 for the pixels PE connected to the $n^{th}$ gate line GLn may be charged at a lower voltage as compared to the first TFTs T1 for the pixels connected to the 1st gate line GL1. However, the storage capacitors Cst for the pixels PE connected to the $n^{th}$ gate line GLn still may be pre-charged to the threshold voltage Vth by discharging the voltage difference {VDD−Vf−Vpc−(VDD−Vf−Vth−Vpc)}, thereby compensating a voltage drop of the supply voltage source VDD.

Moreover, each of the storage capacitors Cst may be initially pre-charged to a voltage close to the final pre-charge voltage value by the pre-charge voltage Vpc in the first pre-charge period P1 as shown in FIG. 6. As a result, it becomes possible to sufficiently discharge electric charges on the data line DL within a predetermined time of the second pre-charge period P2 by the floating method. In particular, the pre-charge voltage Vpc may be set to be lower than a target voltage (i.e., VDD−Vf−Vth) to be finally pre-charged in order to compensate for a voltage drop of the supply voltage line connecting to the supply voltage source VDD. In addition, the second pre-charge period P2 using the floating method may be set to be longer than the first pre-charge period P1 using the pre-charge voltage Vpc to ensure a sufficient discharge.

As described above, according to an embodiment of the present invention, a constant voltage can be pre-charged irrespectively of a voltage drop of the supply voltage line using the combination of a pre-charge voltage source and a floating method. Furthermore, according to an embodiment of the present invention, the pre-charge voltage has a voltage value close to the final pre-charge voltage prior to the floating method, so that a sufficient discharge can be made within a predetermined time to arrive at a target pre-charge voltage value.

It will be apparent to those skilled in the art that various modifications and variations can be made in the method and apparatus for pre-charging an electro-luminescence display panel of the present invention without departing from the spirit or scope of the invention. Thus, it is intended that the present invention covers the modifications and variations of this invention provided they come within the scope of the appended claims and their equivalents.

What is claimed is:

1. An electro-luminescence (EL) display device, comprising:

an electro-luminescence display panel including a plurality of pixels arranged in a matrix form at pixel areas defined by intersections between gate lines and data lines, each of the pixels having an EL cell connected to a first voltage source and a cell driver, the cell driver connected to a respective one of the gate lines and a respective one of the data lines and connected between a second voltage source and the EL cell; and a pre-charger for pre-charging a storage capacitor in the cell driver into a first pre-charge voltage using a pre-charge voltage source and then floating the respective data line in a pre-charge period prior to an application of a data signal, thereby arriving at a second pre-charge voltage by a discharge of the first pre-charge voltage of the storage capacitor.

2. The device according to claim 1, wherein the cell driver includes:

first and second thin film transistors forming a current mirror between the second voltage source and the EL cell and having the storage capacitor connected between a second supply voltage line and gate electrodes thereof;

a third thin film transistor connected between the data line and the first thin film transistor and controlled by the gate line; and a fourth thin film transistor connected between the third thin film transistor and the storage capacitor and controlled by the gate line.

3. The device according to claim 2, wherein the second pre-charge voltage is a threshold voltage of the first thin film transistor.

4. The device according to claim 3, wherein the first pre-charge voltage is lower than a voltage difference (VDD−Vf−Vth) between a second supply voltage (VDD−Vf) supplied to each pixel and the threshold voltage (Vth) of the first thin film transistor, the second supply voltage being applied from the second voltage source via the second supply voltage line including a voltage drop (Vf).

5. The device according to claim 1, wherein the pre-charger includes:

a first switch for disconnecting the data line from a data signal supplier supplying the data signal in the pre-charge period; and a second switch for connecting the data line to the pre-charge voltage source in a first pre-charge interval of the pre-charge period.

6. The device according to claim 5, wherein the first and second switches disconnect the data line from the data signal supplier and the pre-charge voltage source in a second pre-charge interval of the pre-charge period to thereby float the data line.

7. The device according to claim 6, wherein the second pre-charge interval is longer than the first pre-charge interval.

8. A method of pre-charging an electro-luminescence (EL) display panel, comprising:

pre-charging a storage capacitor of a pixel connecting to a data line and a gate line in the EL display panel to a first pre-charge voltage using a pre-charge voltage source during a first pre-charge interval; and floating the data line to arrive at a second pre-charge voltage by a discharge of the first pre-charge voltage at the storage capacitor during a second pre-charge interval.

9. The method according to claim 8, wherein the EL display panel includes:

a plurality of the data lines and the gate lines crossing one another defining a plurality of pixel areas, an EL cell at each of the pixel areas connected to a first voltage source and a cell driver, the cell driver connected to a respective one of the gate lines and a respective one of the data lines and connected between a second voltage source and the EL cell, wherein the cell driver includes:

first and second thin film transistors forming a current mirror between the second voltage source and the EL cell and having the storage capacitor connected between a second supply voltage line and gate electrodes thereof;

a third thin film transistor connected between the data line and the first thin film transistor and controlled by the gate line; and a fourth thin film transistor connected between the third thin film transistor and the storage capacitor and controlled by the gate line.

10. The method according to claim 9, wherein the second pre-charge voltage is a threshold voltage of the first thin film transistor.

11. The method according to claim 10, further comprising setting the first pre-charge voltage to be lower than a voltage difference (VDD−Vf−Vth) between a second supply voltage (VDD−Vf) supplied to each pixel and the threshold voltage (Vth) of the first thin film transistor, the second supply voltage being applied from the second voltage source via the second supply voltage line including a voltage drop (Vf).

12. The method according to claim 8, further comprising setting the second pre-charge interval to be longer than the first pre-charge interval.

13. The method according to claim 8, wherein the step of pre-charging the storage capacitor during the first pre-charge interval includes selectively connecting the data line to the pre-charge voltage source using a first switch.

14. The method according to claim 8, wherein the step of floating the data line during the second pre-charge interval includes selectively disconnecting the data line from the pre-charge voltage source using a first switch; and selectively disconnecting the data line from a data signal supplier for supplying a data signal using a second switch.

15. An apparatus of pre-charging an electro-luminescence (EL) display panel, comprising:

pre-charging means for pre-charging a storage capacitor of each pixel connected to gate lines supplied with a scanning pulse using a first pre-charging step during a first pre-charging period and then a second pre-charging step during a second pre-charging period prior to an application of a data signal, the first and second pre-charging steps being different from each other.

16. The apparatus according to claim 15, wherein the second pre-charging period is longer than the first pre-charging period.

17. A method of pre-charging an electro-luminescence (EL) display panel, comprising:

pre-charging a storage capacitor of each pixel connected to gate lines supplied with a scanning pulse in at least a first pre-charging step during a first pre-charging period and a second pre-charging step during a second pre-charging period before an application of a data signal, the first and second pre-charging step being different from each other.

18. The method according to claim 17, further comprising setting the second pre-charging period to be longer than the first pre-charging period.

* * * * *